US006117026A

United States Patent [19]

Hayashi et al.

[11] Patent Number: 6,117,026

[45] Date of Patent: Sep. 12, 2000

[54] MULTI-PIECE SOLID GOLF BALL

[75] Inventors: Junji Hayashi; Hisashi Yamagishi; Yasumasa Shimizu, all of Chichibu, Japan

[73] Assignee: Bridgestone Sports Co., Ltd., Tokyo, Japan

[21] Appl. No.: 09/195,997

[22] Filed: Nov. 20, 1998

[30] Foreign Application Priority Data

Nov. 20, 1997 [JP] Japan ..... 9-336435

[51] Int. Cl.[7] ..... A63B 37/04; A63B 37/06

[52] U.S. Cl. ..... 473/374; 473/371; 473/372; 473/373; 473/374; 473/376; 473/377; 473/378

[58] Field of Search ..... 473/370, 371, 473/372, 373, 374, 376, 377, 378

[56] References Cited

U.S. PATENT DOCUMENTS

| | | | |
|---|---|---|---|
| 5,253,871 | 10/1993 | Violaz et al. | 473/228 |
| 5,688,595 | 11/1997 | Yamagishi et al. | 473/375 |
| 5,702,311 | 12/1997 | Higuchi | 473/373 |
| 5,816,944 | 10/1998 | Asakura et al. | 473/372 |
| 5,820,492 | 10/1998 | Yamagishi et al. | 473/377 |
| 5,830,086 | 11/1998 | Hayashi | 473/376 |
| 5,885,172 | 3/1999 | Hebert | 473/354 |
| 5,888,151 | 3/1999 | Hayashi | 473/363 |
| 5,948,862 | 9/1999 | Sano | 525/89 |
| 5,967,907 | 10/1999 | Takemura | 473/373 |
| 5,980,396 | 11/1999 | Moriyama | 473/376 |
| 5,994,470 | 11/1999 | Tanaka | 525/183 |
| 6,034,182 | 3/2000 | Kashiwagi | 525/240 |

FOREIGN PATENT DOCUMENTS

| | | |
|---|---|---|
| 58-92372 | 6/1983 | Japan . |
| 4-96771 | 3/1992 | Japan . |
| 6-80718 | 3/1994 | Japan . |
| 6-114124 | 4/1994 | Japan . |
| 7-24085 | 1/1995 | Japan . |

*Primary Examiner*—Stephen F. Gerrity
*Assistant Examiner*—Paul D. Kim
*Attorney, Agent, or Firm*—Sughrue, Mion, Zinn, Macpeak & Seas, PLLC

[57] ABSTRACT

A multi-piece solid golf ball includes an inner sphere (1), at least one enclosure layer (2), a cover inner layer (4), and a cover outer layer (5). The inner sphere has a deflection of 3.5–8.0 mm under a load of 100 kg. The enclosure layer is formed of an ionomer resin with a high acid content. The cover outer layer has a Shore D hardness of 40–60, and the cover inner layer has a lower Shore D hardness of 10–50 than the outer layer. The golf ball is improved in flight distance, spin performance, scuff resistance and durability against repetitive shots while giving a soft pleasant feel when hit with any club ranging from a driver to a putter.

16 Claims, 1 Drawing Sheet

MULTI-PIECE SOLID GOLF BALL

BACKGROUND OF THE INVENTION

1. Field of the Invention

The present invention relates to a multi-piece solid golf ball with at least a four-layer construction.

2. Prior Art

Golf balls having a variety of constructions are available today on the market. Of these, the golf balls generally used for competitive play are either two-piece solid golf balls having a rubber-based core enclosed within a cover made of ionomer resin or the like, or thread-wound golf balls comprising a solid or liquid center about which is wound a rubber thread which is in turn enclosed within a cover.

Most golfers of ordinary skill use two-piece solid golf balls because of their excellent flight performance and durability. However, as compared with thread-wound golf balls, the two-piece solid golf balls have a very hard feel when hit, and are difficult to control because of the rapid separation of the ball from the head of the club.

This situation has prompted efforts to approximate the feel of a thread-wound golf ball in a solid golf ball. As a result, a number of soft, two-piece solid golf balls have been proposed. A soft core is used to obtain such soft two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use.

Ionomer base resin materials are often used as the cover of golf balls. A variety of proposals have been made as to improvements in the resilience of ionomer resins. For example, JP-A 96771/1992, 114124/1994, and 80718/1994 disclose ionomer resins having higher contents of α,β-unsaturated carboxylic acid (simply referred to as acid contents) than prior art ionomer resins. In general, as the acid content increases, the ionomer resin has a higher hardness, a higher rigidity and greater resilience, but becomes brittle. When the ionomer resin is used as the cover stock of golf balls which is subject to substantial deformation, the durability against repetitive shots is markedly exacerbated. As a result of becoming harder and losing friction, the spin performance upon approach shots is markedly exacerbated. The hard cover gives a hard feel when hit, especially on putting and approach shots. As one solution to these drawbacks, JP-A 92372/1983 and 24085/1995 disclose a two-layer cover structure wherein a soft resin overlies a hard resilient resin for taking advantage of the resilience of the inner layer without detracting from spin performance and soft hitting feel. However, the soft outer/hard inner two-layer cover is susceptible to scuff damages by friction between the club face and the cover upon iron shots.

SUMMARY OF THE INVENTION

Therefore, an object of the invention is to provide a solid golf ball which is improved in resilience, flight performance, spin performance, durability, and scuff resistance and gives a soft feel to all shots.

The present invention provides a multi-piece solid golf ball comprising a multiple solid core including an inner sphere and at least one enclosure layer surrounding the center, and a cover consisting essentially of an inner layer surrounding the core and an outer layer surrounding the inner layer. The cover outer layer has a Shore D hardness of 40 to 60. The cover inner layer has a Shore D hardness of up to 50 and lower than the hardness of the cover outer layer. The enclosure layer is formed mainly of an ionomer resin in the form of a metal ion-neutralized ethylene-α,β-unsaturated carboxylic acid copolymer containing at least 16% by weight of α,β-unsaturated carboxylic acid. The inner sphere has a hardness corresponding to a deflection of 3.5 to 8.0 mm under an applied load of 100 kg.

In the golf ball of the invention, an ionomer resin having a high acid content is used in the enclosure layer subject to relatively small deformation upon shots rather than the ball surface (cover outer layer) subject to large deformation upon shots, for thereby improving resilience while maintaining durability. Additionally, a relatively soft resin is used in the cover outer layer for improving spin performance and hitting feel, and a soft resin is interposed between the cover outer layer and the enclosure layer for improving scuff resistance. Further, the soft inner sphere is effective for improving the feel upon full shots with driver or other clubs. As a result, the golf ball is improved in resilience and hence, flight performance, spin performance, durability, and scuff resistance and gives a soft feel to all shots.

BRIEF DESCRIPTION OF THE DRAWINGS

The sole FIGURE.

DETAILED DESCRIPTION OF THE INVENTION

Figure 1:
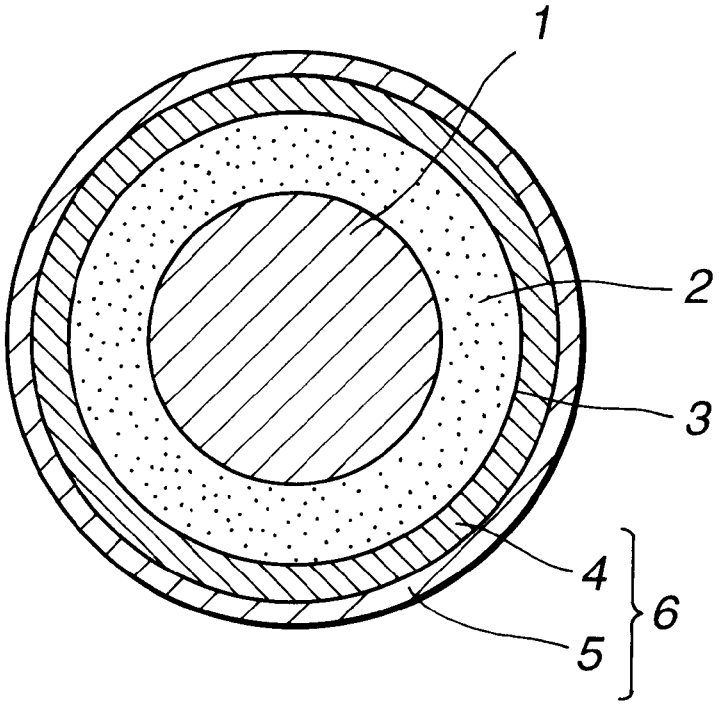
FIG. 1 is a cross-sectional view of a golf ball according to one embodiment of the invention.

Referring to FIG. 1, the multi-piece solid golf ball according to the present invention is comprised of a multiple solid core 3 and a cover 6 enclosing the core 3. The multiple solid core 3 has an inner sphere 1 which is surrounded by an enclosure layer 2. The cover 6 includes an inner layer 4 surrounding the enclosure layer 2 and an outer layer 5 surrounding the inner layer 4. All layers are in concentric arrangement.

The multiple solid core 3 includes the inner sphere 1 and at least one enclosure layer 2. The the ball is a four-piece solid golf ball when only one enclosure layer is formed, and a five-piece solid golf ball when the enclosure layer consists of two layers.

Like solid cores of prior art two-piece solid golf balls, the inner sphere is formed of a rubber base composed mainly of cis-1,4-polybutadiene. Most often, the inner sphere is formed by conventionally molding a well-known rubber composition comprising a base rubber, co-crosslinking agent, crosslinking agent, filler, and other additives. The base rubber containing at least 90% of cis-1,4-polybutadiene is preferable for high resilience. Another rubber component such as natural rubber and polyisoprene rubber may be blended in the base rubber as long as the objects of the invention are not impaired. The co-crosslinking agent used herein may be selected from zinc and magnesium salts of unsaturated fatty acids such as methacrylic acid and acrylic acid and esters such as trimethylpropane trimethacrylate, which are used in conventional solid golf balls. Zinc acrylate is especially preferred for high resilience. The co-crosslinking agent is preferably used in an amount of about 5 to 35 parts by weight per 100 parts by weight of the base rubber. Various crosslinking agents are useful although peroxides are preferred. Dicumyl peroxide or a mixture of dicumyl peroxide and 1,1-bis(t-butylperoxy)-3,3,5-trimethylcyclohexane is preferred. The peroxide is preferably blended in an amount of about 0.5 to 1.5 parts by weight per 100 parts by weight of the base rubber. If desired, the rubber composition contains fillers such as zinc oxide and barium sulfate. The amount of the filler blended for gravity adjustment is not critical. An appropriate amount of the filler is determined in the range of 0 to 100 parts by weight per 100 parts by weight of the base rubber, so as to give a ball weight of not greater than 45.93 g. Further, antioxidants and other well-known additives may be blended.

The inner sphere should have a hardness corresponding to a deflection of 3.5 to 8.0 mm, preferably 3.8 to 7.0 mm, under an applied load of 100 kg. With a deflection of less than 3.5 mm, the core is too hard to give a good feeling. With a deflection of more than 8.0 mm, the core is too soft to provide flight performance.

The inner sphere should preferably have a diameter of 26.5 to 39.0 mm, especially 28.0 to 37.0 mm. An inner sphere with a smaller diameter leads to a shortage of resilience, failing to offer a soft feel upon full shots with driver and other clubs. If the diameter of the inner sphere is too large, the thicknesses of the enclosure layer, cover inner layer and cover outer layer must be accordingly reduced so that the respective layers might perform less in their own effect. Preferably, the inner sphere has a weight of 13 to 36 g.

The enclosure layer is formed mainly of an ionomer resin. The ionomer resin used herein is selected from ethylene-α, β-unsaturated carboxylic acid copolymers containing at least 16% by weight, preferably 18 to 25% by weight of α,β-unsaturated carboxylic acid, which are neutralized with a metal ion, especially a metal ion selected from the group consisting of Li, Na, K, Mg, Zn, Cu, Ba, Pb, and Al. No sufficient resilience would be obtained if the content of α,β-unsaturated carboxylic acid is less than 16% by weight. The α,β-unsaturated carboxylic acids used herein are preferably those of 2 to 8 carbon atoms, for example, acrylic acid and methacrylic acid. The neutralization amount with the metal ion is preferably 10 to 100 mol %, especially 20 to 80 mol %.

The ionomer resins may be used alone or in admixture of two or more. As previously described, two or more enclosure layers may be provided on the inner sphere. The enclosure layer preferably has a Shore D hardness of at least 62, especially 63 to 75. An enclosure layer with a lower hardness would provide less resilience.

For maintaining satisfactory resilience and feel, the thickness of the enclosure layer is preferably 0.5 to 3.0 mm, especially 0.7 to 2.8 mm.

The solid core formed of the inner sphere surrounded by the enclosure layer preferably has a diameter of 32.5 to 40.0 mm, especially 33.5 to 39.0 mm.

The solid core is enclosed with the cover which consists essentially of the cover inner and outer layers. The cover inner layer should have a Shore D hardness of up to 50, preferably 10 to 45, more preferably 10 to 40. If the hardness of the inner layer is in excess of 50 Shore D, the cover is susceptible to scuff damage upon iron shots and gives a rather hard feel upon approach and putting shots.

The cover inner layer may be formed mainly of an ionomer resin, thermoplastic elastomer or a mixture thereof. Ionomer resins and thermoplastic elastomers are commercially available. Useful examples include ionomer resins commercially available under Surlyn from E.I. duPont and Himilan from Mitsui-duPont Polychemical K.K., polyester elastomers commercially available under Hytrel from Toray-duPont K.K., polyurethane elastomers commercially available under Pandex from Dainippon Ink & Chemicals K.K., and polyamide elastomers commercially available under Pebax from Atochem. Of these, thermoplastic polyesters having a Shore D hardness of 10 to 40 are especially preferred.

The cover inner layer preferably has a thickness of 0.3 to 2.5 mm, especially 0.5 to 2.3 mm.

On the other hand, the cover outer layer should have a Shore D hardness of 40 to 60, preferably 45 to 60. An outer layer with a Shore D hardness of less than 40 would fail to provide resilience. An outer layer with a Shore D hardness of more than 60 would invite disadvantages including hard feeling upon approach and putting shots, insufficient spin performance, and poor durability against repetitive shots.

The cover outer layer is formed to a higher hardness than the cover inner layer. If the cover outer layer has a lower hardness than the cover inner layer, sufficient resilience would be not obtained. The difference in hardness between the cover outer layer and the cover inner layer is preferably 10 to 50 Shore D units, especially 15 to 40 Shore D units.

The cover outer layer may also be formed mainly of an ionomer resin, thermoplastic elastomer or a mixture thereof, with the ionomer resin being preferred.

The cover outer layer preferably has a thickness of 0.3 to 2.5 mm, especially 0.5 to 2.3 mm. The total thickness of the cover (that is, inner layer plus outer layer) is preferably 1.3 to 5.1 mm, especially 1.8 to 4.6 mm.

In the compositions of which the enclosure layer and cover layers are made, various additives, for example, pigments, dispersants, antioxidants, UV absorbers, and parting agents may be added in conventional amounts in addition to the above-mentioned resin components.

Methods of forming the enclosure layer on the inner sphere and the cover inner and outer layers on the core are not critical. A compression molding procedure involves preforming a pair of half cups from a layer-forming composition and encasing the sphere or core in the pair of half cups, followed by molding under heat and pressure. Alternatively, layer-forming compositions are sequentially injection molded over the sphere. A combination of these procedures is also acceptable.

Like conventional golf balls, the golf ball of the invention is provided with a plurality of dimples on the cover surface, typically at the same time as cover molding. The ball on the surface is then subjected to finishing steps including buffing, painting, and stamping.

While the above construction is met, the solid golf ball of the invention may be formed so as to have a diameter of not less than 42.67 mm and a weight of not greater than 45.93 g in accordance with the Rules of Golf.

The golf ball of the invention gives a soft pleasant feel when hit with any club ranging from a driver to a putter. The ball is also minimized in head speed dependency so that not only average to high head speed players, but also low head speed players may get a good feeling and distance. Moreover, the ball is improved in flight distance, spin performance, scuff resistance and durability against repetitive shots.

EXAMPLE

Examples of the invention are given below by way of illustration, and are not intended to limit the invention. Note that Surlyn is the trade name of ionomer resins from E.I. duPont; Himilan is the trade name of ionomer resins from Mitsui-duPont Polychemical K.K.; and Hytrel is the trade name of polyester elastomers from Toray-duPont K.K.

Examples 1–5 and Comparative Examples 1–3

Inner spheres each were prepared by milling ingredients of a rubber composition of the formulation shown in Table 1 in a roll mill, and molding and vulcanizing the composition in a mold at 155° C. for 15 minutes. The inner spheres had a diameter and hardness as shown in Table 2. The compositions for the enclosure layer, cover inner layer, and cover outer layer, each of the formulation shown in Table 1, were injection molded over the inner sphere in this order. The enclosure layer, cover inner layer, and cover outer layer had a hardness and gage as shown in Table 2.

The thus obtained golf balls were examined for flight performance, spin performance, scuff resistance, durability against repetitive hits, and feel by the following tests. The results are shown in Table 2.

(1) Hardness of enclosure layer, cover inner layer, and cover outer layer

Hardness was measured with a Shore D Durometer.

(2) Flight performance

Using a swing robot, the ball was struck with a driver (W#1) at a head speed of 45 m/s (HS45). A spin rate, initial velocity, and total distance were measured.

(3) Spin performance

Using the swing robot, the ball was struck with a sand wedge (SW) at a head speed of 20 m/s (HS20) for measuring a spin rate.

(4) Scuff resistance

Using the swing robot, the ball was struck in a cut-shot manner with a pitching wedge at a head speed of 32 m/s. The surface state of the ball was visually observed and rated according to the following criterion.

Ex: no damages, fully playable

Good: perceivable damages, but playable without worries

Poor: heavy damages, unplayable (5) Durability against repetitive hits

Using the swing robot, the golf ball was repetitively hit with a driver at a head speed of 40 m/s until it was broken. The number of hits was expressed as an index of durability based on 100 for Example 1.

(6) Feel

The balls were hit by five professional golfers with a driver at a head speed of about 45 m/s, a sand wedge at a head speed of about 20 m/s, and a putter. The golfers evaluated the feel of each ball as "soft," "average" or "hard."

TABLE 1

| | | Example | | | | | Comparative Example | | |
|---|---|---|---|---|---|---|---|---|---|
| | | 1 | 2 | 3 | 4 | 5 | 1 | 2 | 3 |
| Inner sphere | Cis-1,4-polybutadiene | 100 | 100 | 100 | 100 | 100 | 100 | 100 | 100 |
| | Zinc acrylate | 21.2 | 16.3 | 23.7 | 16.3 | 21.2 | 27.2 | 23.7 | 23.7 |
| | Dicumyl peroxide | 0.9 | 0.9 | 0.9 | 0.9 | 0.9 | 0.9 | 0.9 | 0.9 |
| | Antioxidant | 0.2 | 0.2 | 0.2 | 0.2 | 0.2 | 0.2 | 0.2 | 0.2 |
| | Zinc oxide | 5.0 | 5.0 | 5.0 | 5.0 | 5.0 | 5.0 | 5.0 | 5.0 |
| | Barium sulfate | 36.7 | 56.0 | 37.2 | 34.1 | 34.1 | 17.8 | 31.7 | 37.2 |
| Enclosure layer (trade name/ acid content (%)/ metal ion) | Surlyn AM7315/20/Zn | 50 | 50 | 50 | — | — | | | — |
| | Surlyn AD8546/19/Li | 50 | 50 | 50 | — | — | | | — |
| | Surlyn AM7317/18/Zn | — | — | — | 50 | — | | | — |
| | Surlyn AM7318/18/Na | — | — | — | 50 | — | | | — |
| | Surlyn 8220/20/Na | — | — | — | — | 100 | | | — |
| | Himilan 1706/15/Zn | — | — | — | — | — | | | 50 |
| | Himilan 1605/15/Na | — | — | — | — | — | | | 50 |
| Cover inner layer | Hytrel 3078 | 100 | 100 | 100 | — | — | | — | 100 |
| | Hytrel 4047 | — | — | — | — | 100 | | — | — |
| | Surlyn 8120 | — | — | — | 50 | — | | — | — |
| | Himilan 1855 | — | — | — | 50 | — | | — | — |
| | Himilan 1706 | — | — | — | — | — | | 50 | — |
| | Himilan 1605 | — | — | — | — | — | | 50 | — |
| Cover outer layer | Himilan 1557 | 50 | 50 | — | 50 | 50 | — | 50 | — |
| | Himilan 1605 | 50 | 50 | — | — | 50 | — | — | — |
| | Surlyn 8120 | — | — | 100 | — | — | — | — | 100 |
| | Himilan 1856 | — | — | — | 50 | — | — | 50 | — |
| | Surlyn AM7315 | — | — | — | — | — | 50 | — | — |
| | Surlyn AD8546 | — | — | — | — | — | 50 | — | — |

TABLE 2

| | | Example | | | | | Comparative Example | | |
|---|---|---|---|---|---|---|---|---|---|
| | | 1 | 2 | 3 | 4 | 5 | 1 | 2 | 3 |
| Structure | | 4 layers | 4 layers | 4 layers | 4 layers | 4 layers | 2 layers | 3 layers | 4 layers |
| Inner sphere | Diameter (mm) | 33.1 | 30.1 | 32.7 | 35.7 | 33.1 | 39.1 | 35.7 | 32.7 |
| | Hardness* (mm) | 5.0 | 6.0 | 4.5 | 6.0 | 5.0 | 3.8 | 4.5 | 4.5 |
| Enclosure layer | Shore D | 67 | 67 | 67 | 65 | 68 | | | 63 |
| | Gage (mm) | 1.5 | 2.5 | 2.0 | 1.5 | 1.5 | | | 2.0 |
| Cover inner layer | Shore D | 30 | 30 | 30 | 50 | 40 | | 63 | 30 |
| | Gage (mm) | 1.5 | 1.8 | 1.5 | 1.0 | 1.5 | | 2.0 | 1.5 |
| Cover outer layer | Shore D | 58 | 58 | 47 | 55 | 58 | 67 | 55 | 47 |
| | Gage (mm) | 1.8 | 2.0 | 1.5 | 1.0 | 1.8 | 1.8 | 1.5 | 1.5 |
| Shore D difference of | | 28 | 28 | 17 | 5 | 18 | — | −8 | 17 |

TABLE 2-continued

| | | Example | | | | | Comparative Example | | |
|---|---|---|---|---|---|---|---|---|---|
| | | 1 | 2 | 3 | 4 | 5 | 1 | 2 | 3 |
| cover (outer layer - inner layer) | | | | | | | | | |
| Flight performnce (W#1/HS45) | Spin (rpm) | 2710 | 2750 | 2800 | 2690 | 2700 | 2750 | 2650 | 2790 |
| | Initial velocity (m/s) | 65.2 | 65.1 | 65.1 | 65.0 | 65.2 | 65.3 | 65.1 | 64.5 |
| | Total (m) | 226.5 | 226.0 | 225.8 | 226.0 | 226.8 | 227.2 | 226.4 | 221.8 |
| Spin performance (SW/HS20) | Spin (rpm) | 5200 | 5260 | 5820 | 5540 | 5210 | 4130 | 5370 | 5810 |
| Scuff resistance | | Ex | Ex | Good | Ex | Ex | Ex | Poor | Good |
| Durability | | 100 | 100 | 110 | 105 | 103 | 65 | 110 | 110 |
| Feel | W#1/HS-45 | soft | soft | soft | soft | soft | hard | soft | soft |
| | SW/HS-20 | soft | soft | soft | soft | soft | hard | average | soft |
| | Putter | soft | soft | soft | soft | soft | hard | average | soft |

*a deflection (mm) under a load of 100 kg

Comparative Example 1 is a two-piece golf ball having a relatively soft core enclosed with a hard ionomer resin having a high acid content. It shows good resilience and an extended distance, but a poor feel because of its hardness and very poor durability against repetitive hits because of the cover made of the ionomer resin having a high acid content.

Comparative Example 2 is a three-piece golf ball having a core enclosed with a relatively hard ionomer resin and further with a relatively soft ionomer resin. It shows good flight and spin performances, but very poor scuff resistance. The feel of the ball upon putter and approach shots is somewhat hard because the cover inner layer is hard.

Comparative Example 3 is a four-piece golf ball having the enclosure layer of an ionomer resin with a low acid content. It travels a shorter distance because of somewhat low resilience.

In contrast, the four-piece golf balls of Examples 1 to 5 all show excellent flight and spin performances and are improved in scuff resistance, durability against repetitive hits, and feel.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-piece solid golf ball comprising a multiple solid core including an inner sphere and at least one enclosure layer surrounding the center, and a cover consisting essentially of an inner layer surrounding the core and an outer layer surrounding the inner layer, wherein said cover outer layer has a Shore D hardness of 40 to 60, said cover inner layer has a Shore D hardness of up to 50 and lower than the hardness of said cover outer layer, said enclosure layer is formed mainly of an ionomer resin in the form of a metal ion-neutralized ethylene-α,β-unsaturated carboxylic acid copolymer containing at least 16% by weight of α,β-unsaturated carboxylic acid, and said inner sphere has a hardness corresponding to a deflection of 3.5 to 8.0 mm under an applied load of 100 kg.

2. The golf ball of claim 1 where in said enclosure layer has a thickness of 0.5 to 3.0 mm, the metal ion of the ionomer resin is selected from the group consisting of Li, Na, K, Mg, Zn, Cu, Ba, Pb, and Al.

3. The golf ball of claim 1 wherein said cover inner layer has a thickness of 0.3 to 2.5 mm, said cover outer layer has a thickness of 0.3 to 2.5 mm, and the difference in hardness between said cover outer layer and said cover inner layer is 10 to 50 Shore D units.

4. The golf ball of claim 1 wherein said inner sphere is formed of a rubber base composed mainly of cis-1,4-polybutadiene and has a diameter of 26.5 to 39.0 mm, and the core multiple solid has a diameter of 32.5 to 40.0 mm.

5. The golf ball of claim 1 wherein said cover inner layer is comprised of a thermoplastic polyester having a Shore D hardness of 10 to 40.

6. The golf ball of claim 1, wherein said inner sphere has a hardness corresponding to 3.8 to 7.0 mm under an applied load of 100 kg.

7. The golf ball of claim 1, wherein said inner sphere has a diameter in the range of 28.0 to 37.0 mm.

8. The golf ball of claim 1, wherein said enclosure layer has a Shore D hardness of at least 62.

9. The golf ball of claim 1, wherein said enclosure layer has a Shore D hardness in the range of 63 to 75.

10. The golf ball of claim 1, wherein said enclosure layer has a thickness in the range of 0.5 to 3.0 mm.

11. The golf ball of claim 1, wherein said multiple solid core has a diameter in the range of 33.5 to 39.0 mm.

12. The golf ball of claim 1, wherein said cover inner layer has a Shore D hardness not exceeding 50.

13. The golf ball of claim 1, wherein said cover inner layer has a thickness in the range of 0.5 to 2.3 mm.

14. The golf ball of claim 1, wherein said cover outer layer has a Shore D hardness in the range of 40 to 60.

15. The golf ball of claim 1, wherein said cover outer layer has a thickness in the range of 0.5 to 2.3 mm.

16. The golf ball of claim 1, wherein said cover inner and outer layers have a total thickness in the range of 1.3 to 5.1 mm.

* * * * *